United States Patent [19]

Rohner

[11] Patent Number: 4,863,042

[45] Date of Patent: Sep. 5, 1989

[54] FILE TRAY

[75] Inventor: Benedikt Rohner, Zürich, Switzerland

[73] Assignee: Biella-Neher AG, Biel, Switzerland

[21] Appl. No.: 307,960

[22] Filed: Feb. 9, 1989

[30] Foreign Application Priority Data

Feb. 9, 1988 [CH] Switzerland ..... 464/88

[51] Int. Cl.[4] ..... A47F 5/00

[52] U.S. Cl. ..... 211/11; 211/126; 211/194

[58] Field of Search ..... 211/11, 126, 130, 194, 211/50

[56] References Cited

U.S. PATENT DOCUMENTS 2,650,150 8/1953 Smith et al. ..... 211/130 X 2,772,003 11/1956 Volz ..... 211/130

4,456,128 6/1984 Warshaw ..... 211/11

FOREIGN PATENT DOCUMENTS 984056 2/1965 United Kingdom ..... 211/40

*Primary Examiner*—Robert W. Gibson, Jr.

*Attorney, Agent, or Firm*—Oblon, Spivak, McClelland, Maier & Neustadt

[57] ABSTRACT

The file tray comprises a plurality of superposed file boxes (1–3) interconnected by guide-rods (4–7) in such a way that an upper box can be spaced from a lower one. For the purpose of limiting their rotation, the guide-rods are provided with stop means comprising blocking ridges (16) on heels (**4*a*–71, 4*b*–7*b***) joined to the guide-rods. The heels co-operate with rims projecting toward the guide-rods from the edges of the boxes.

10 Claims, 3 Drawing Sheets

FILE TRAY

This invention relates to office equipment, and more particulary to a file tray of the type having a plurality of file boxes disposed one above the other and interconnected by guide-rods in such a way that an upper box can be spaced from a lower one.

File trays of this type have already been proposed, but they suffer from the drawback, among others, that the vertical spacing between two adjacent boxes is too small to allow convenient insertion of files or other papers. One reason for this is that the guide-rods connecting adjacent boxes can pivot until the bottom of the upper box comes to rest on the top edge of the lower box. Consequently, the extent of pivoting of the guide-rods is not limited and depends completely upon the dimensions of the boxes.

It is an object of this invention to provide an improved file tray which avoids this drawback and in which the height of the insertion openings, determined in the prior art by the dimensions of vertically adjacent file boxes, can be freely chosen regardless of those dimensions.

To this end, in the file tray according to the present invention, of the type initially mentioned, the guide-rods are provided with stop means to limit their possible pivoting relative to the respective file box, the stop means including blocking ridges on heels joined to the guide-rods, which heels co-operate with rims of the respective box projecting toward the guide-rods.

A preferred embodiment of the invention will now be described in detailed with reference to the accompanying drawings, in which.

Figure 3:
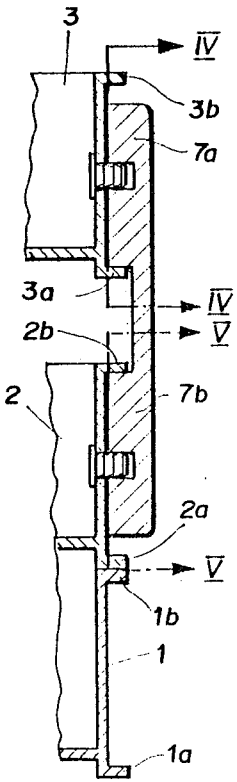
Figure 2:
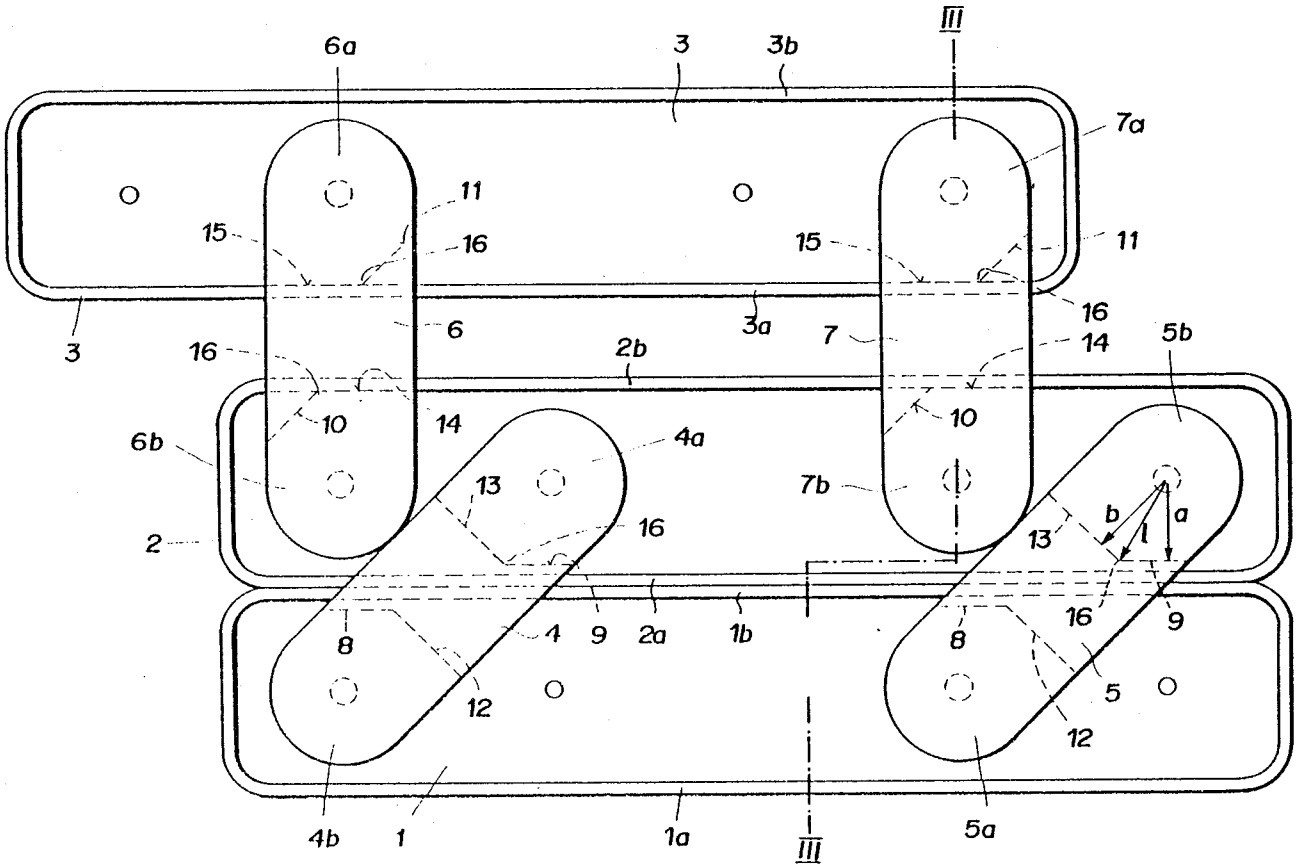
FIG. 2 is a side elevation of the file tray.
Figure 5:
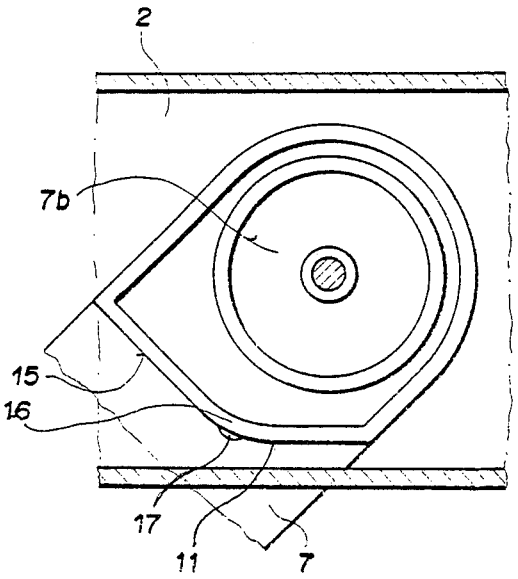

FIG. 3 a section taken on the line III—III of FIG. 2,

FIG. is a section on a larger scale taken on the line IV—IV of FIG. 3, showing a modified form of the heels, and FIG. 5 is an analogous section taken on the line V—V of FIG. 3, with the guide-rod in pivoted position.

Figure 1:
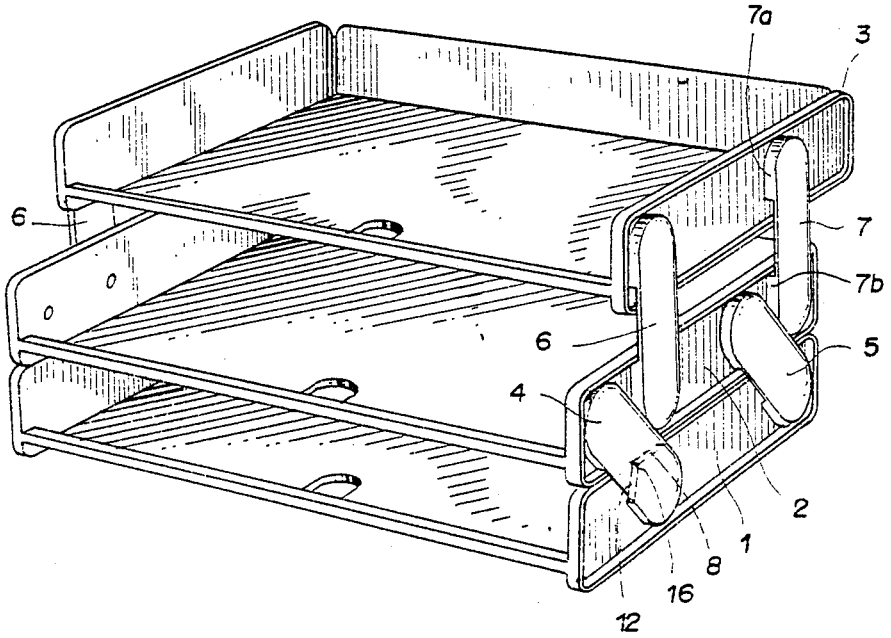
FIG. 1 is a perspective view of the file tray.

The embodiment of the file tray illustrated in FIG. 1 has three file boxes 1—3, boxes 1 and 2 being connected by guide-rods 4 and 5 and boxes 2 and 3 by guide-rods 6 and 7 Box 2 can be lifted off box 1 by pivoting guide-rods 4 and 5, while pivoting guide-rods 6 and 7 raises box 3 from box 2. The raising of whichever box is uppermost would, however, be cancelled out if the guide-rods of that box could pivot unrestrainedly farther under the weight of the box, or of the papers contained in it; for in that case pivoting would continue until the bottom edge of the upper box again came to rest on the top edge of the lower box. The opening between two adjacent boxes (insertion opening) would thereby be reduced, i.e., the width of this insertion slot would depend upon the dimensions of the tray, which is precisely what is to be avoided.

For this purpose, as may be seen in FIG. 2 guide-rods 4–7 are provided at the ends, on the faces thereof nearest the respective boxes, with heels 4*a*–7*a* and 4*b*–7*b* which fit against projecting side rims 1*a*–3*a* and 1*b*–3*b* of file boxes 1–3 and each have a plane surface 8–11 and an adjoining limiting face 12–15. Stop means in the form of blocking ridges 16 are formed by the intersection of a plane surface 8–11 and the adjoining limiting face 12–15. The dimensions are such that according to the pivoting angle of guide-rods 4–7, these ridges simultaneously come in respective contact with the bottom rim of the then upper box and with the top rim of the then lower box, the respective blocking ridges 16 lying parallel to one another so that they come to rest at the same time on the associated rims of the boxes.

If, therefore, starting from the basic position of boxes 1 and 2 shown in FIG. 2, guide-rods 4 and 5 are rotated counterclockwise until box 2 is lifted off box 1 as far as box 3 is shown spaced from box 2, blocking ridges 16 come up against box rims 2*a* and 3*a*, whereby the uppermost box, i.e., box 3 in this example, is secured in its top position, and there can be no further rotation which would lessen the insertion opening.

In a particularly advantageous embodiment, box rims 1*a*–3*a* and 1*b*–3*b* are made of a yielding material, e.g., a suitable plastic. Then, if distance l between blocking ridge 16 and the pivot point of the respective guide-rod is greater than distance a between surface 8–11 and that pivot point and greater than distance b between limiting face 12–15 and that pivot point, as is the case in the example illustrated, there is a kind of brake action by means of which the guide-rods in question are held in their upright position.

Figure 4:
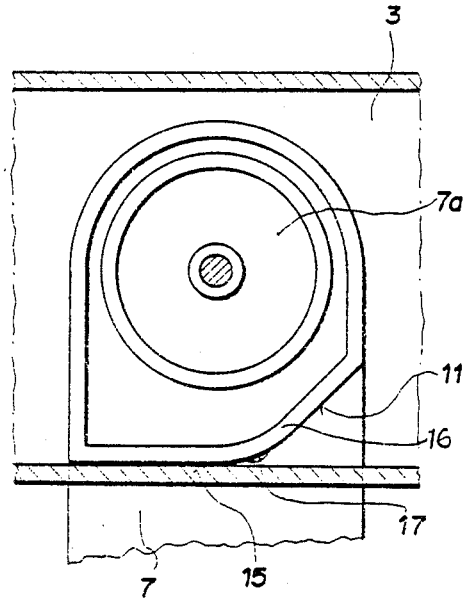

FIGS. 4 and 5 show modified heels 7*a*′ and 7*b*′ which, except for a circular ridge left to provide stability, are hollowed out for purposes of saving on material. A further modification consists in the additional provision of one or more bosses 17 on ridge 16 to augment the braking effect. Bosses 17 further reinforce the transition from plane surfaces 8–11 to limiting faces 12–15, resulting in a kind of locking effect. With reference to file boxes 2 and 3, a total of at least four, or eight, locking points are simultaneously formed by the two guide-rods 6 and the two guide-rods 7 at rims 2*b* and 3*a*, respectively. The result is a more secure, easily releasable blocking of the the file boxes. Owing to the plurality of locking points, deformation of the box rims is very slight. Hence no fatigue or wear and tear occurs on the plastic material used, which in turn contributes to longer life of the file tray.

The arrangement described above makes it possible to keep open the insertion slot between vertically adjacent file boxes and to select it independently of the dimensions of such boxes.

What is claimed is:

1. A file tray of the type having a plurality of file boxes disposed one above the other and interconnected by pivoted guide-rods in such a way that an upper one of the file boxes can be spaced from a lower one, wherein the improvement comprises:

projecting rims extending from the edges of said file boxes toward said guide-rods, a heel joined to each end of each of said guide-rods, facing an associated one of said file boxes, including a plane surface and an adjoining limiting face, and co-operating with respective said projecting rims, and stop means comprising blocking ridges formed by the junctions of each said plane surface and each said limiting face.

2. The file tray of claim 1, wherein the distance between each of said blocking ridges and the pivot point of the associated one of said guide-rods is greater than the distance between said pivot point and said plane surface and greater than the distance between said pivot point and said limiting face.

3. The file tray of claim 2, further comprising at least one boss disposed on each of said blocking ridges.

4. The file tray of claim 2, wherein each of said junctions of a said plane surface and a said limiting face forms an obtuse angle.

5. The file tray of claim 2, wherein all of said blocking ridges are disposed parallel to one another.

6. The file tray of claim 1, wherein said projecting rims are of plastic material.

7. The file tray of claim 6, wherein the distance between each of said blocking ridges and the pivot point of the associated one of said guide-rods is greater than the distance between said pivot point and said plane surface and greater than the distance between said pivot point and said limiting face.

8. The file tray of claim 7, further comprising at least one boss disposed on each of said blocking ridges.

9. The file tray of claim 7, wherein each of said junctions of a said plane surface and a said limiting face forms an obtuse angle.

10. The file tray of claim 7, wherein all of said blocking ridges are disposed parallel to one another.

* * * * *